United States Patent [19]

Zimmerly

[11] Patent Number: 4,524,885

[45] Date of Patent: Jun. 25, 1985

[54] BREAK-AWAY INFLATOR

[76] Inventor: Harry L. Zimmerly, 9641 105th Ave. N., Largo, Fla. 33543

[21] Appl. No.: 457,241

[22] Filed: Jan. 11, 1983

[51] Int. Cl.[3] ..... B63C 9/24

[52] U.S. Cl. ..... 222/5; 441/94

[58] Field of Search ..... 222/3, 5, 6, 80, 81, 222/83; 441/92, 93, 94

[56] References Cited

U.S. PATENT DOCUMENTS

| | | | |
|---|---|---|---|
| 3,248,010 | 4/1966 | De Boer | 222/5 |
| 3,809,288 | 5/1974 | Mackal | 222/5 |
| 4,223,805 | 9/1980 | Mackal | 222/5 |

*Primary Examiner*—Joseph J. Rolla
*Assistant Examiner*—Michael S. Huppert

[57] ABSTRACT

This invention relates to a manually operated inflator for inflatable articles such as life vests and the like. Such inflator, which is typically employed with an inflatable life vest, is operated by pulling on a lanyard attached to a lever which has integrally attached thereto a cam which forces a piercing pin against the seal of the $CO_2$ capsule. In accordance with the invention the hole in the cam which was formerly employed to receive a pivot pin in the prior construction of the inflator has been replaced by a notch which is so disposed angularly with respect to the active surface of the cam that the root of the notch provides for a positive thrusting engagement between it and the pivot pin throughout the angle of rotation of the cam which is necessary to effect the piercing of the seal of the capsule, but provides for the ready escape of the lever end cam from the body of the inflator once the capsule seal has been pierced. The invention makes it impossible for a downed aviator, for example, to pull on the lanyard and thus on the body of the inflator with such undue force as to produce a leak in the life vest, as by rupturing the seal between the manifold and the wall of the vest, or to cause a malfunction of the inflator itself.

12 Claims, 4 Drawing Figures

BREAK-AWAY INFLATOR

This invention relates to an inflator for inflatable articles such as life vests and the like. In the disclosed preferred embodiment thereof, the inflator is operated manually. It is to be understood, however, that the invention may be used in inflators which are capable of operation both manually and automatically.

The invention is illustrated herein in a modification of the manually operated inflator which is disclosed in Mackal U.S. Pat. No. 3,809,288. Such inflator, which is typically employed with an inflatable life vest, is operated by pulling on a lanyard attached to a lever which has integrally attached thereto a cam which forces a piercing pin against the seal of the $CO_2$ capsule. The inflator is attached by a "manifold" having a stem sealed to the wall of the inflatable article. A downed aviator, for example, in his anxiety and haste to inflate his life vest, may pull on the lanyard and thus on the body of the inflator with such undue force as to produce a leak in the life vest, as by rupturing the seal between the manifold and the wall of the vest, or a malfunction of the inflator itself.

In order to avoid such damage, it has been proposed to provide a lanyard of the inflator with a frangible link which would be placed in the cord. This solution to the problem has proved to be disadvantageous since at times such frangible link breaks before the $CO_2$ cylinder has been pierced. At other times, the frangible link does not fracture with the limited amount of force which it was desired to have applied to the lanyard of the inflator by the user.

The difficulties encountered in the prior art and in the above proposal are overcome by the present invention. In accordance with the invention the hole in the cam which has formerly employed to receive a pivot pin in the prior construction of the inflator has been replaced by a notch which is so disposed angularly with respect to the active surface of the cam that the root of the notch provides for a positive thrusting engagement between it and the pivot pin throughout the angle of rotation of the cam which is necessary to effect the piercing of the seal of the capsule, but provides for the ready escape of the lever end cam from the body of the inflator once the capsule seal has been pierced. Thus the strength of the lanyard, and the strength of its connection to the lever remain as before; the termination of the pull exerted by the user upon the lever and thus upon the body of the inflator occurs, not by the breakage of any element in the operating chain from the hand of the user to the cam of the inflator, but rather automatically terminates the pull exerted by the user upon the inflator only after the level end cam have been turned through a predetermined angle which is sufficient to insure the piercing of the seal of the gas-containing capsule.

The invention will be more readily understood upon consideration of the accompanying drawing, in which.

Figure 2:
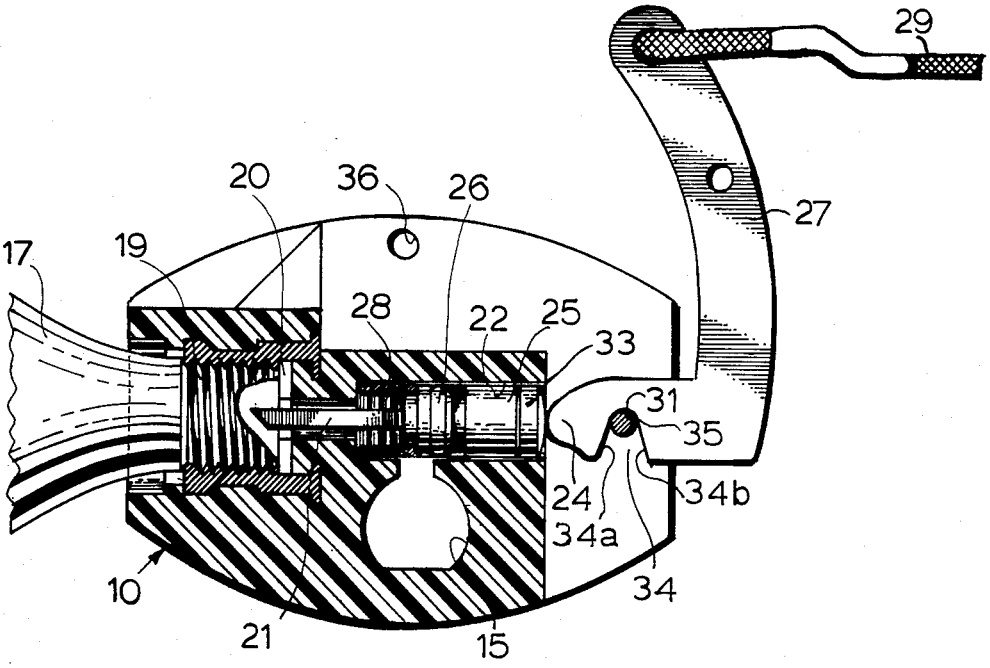
FIG. 2 is a view partially in vertical longitudinal section and partially in side elevation of the inflator of the invention and the neck portion of a gas capsule attached thereto, the lever and cam of the capsule piercing mechanism having been turned through substantially 90 degrees in a clockwise direction from its position in FIG. 1, whereby to effect piercing of the seal of the gas capsule.
Figure 4:
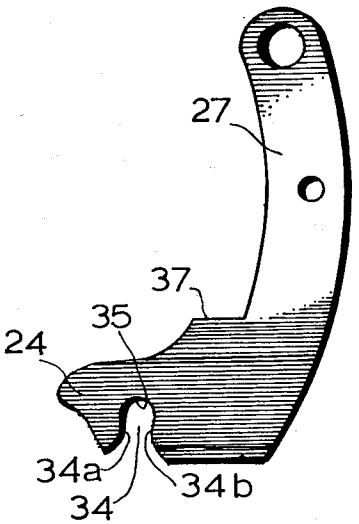
Figure 3:
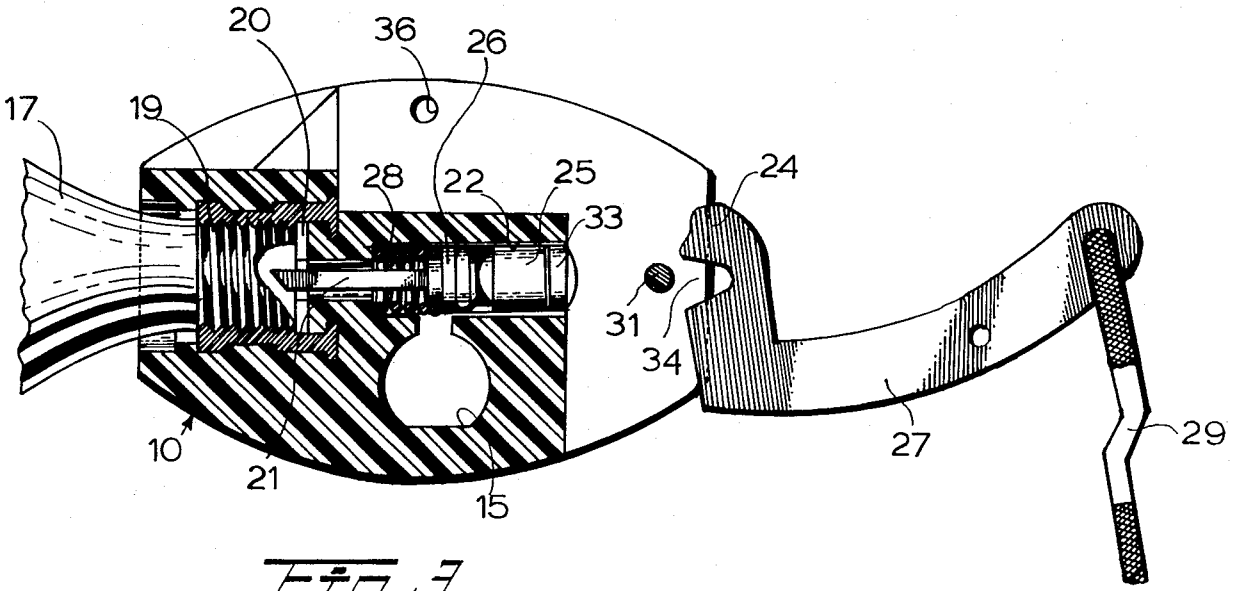

FIG. 3 is a view partially in longitudinal vertical section and partially in said elevation of the inflator of the invention and the neck portion of the gas capsule, the lever and cam having been turned further in a clockwise direction from the position of FIG. 2 into a position wherein a pivot pin upon which the cam is mounted is freed from the notch in the cam so that the cam and lever combination now freely escapes from the body of the inflator during the latter part of the pull exerted upon the lanyard by the user of the inflator; and FIG. 4 is a view in side elevation of a modified cam and lever combination for use with the inflator.

Figure 1:
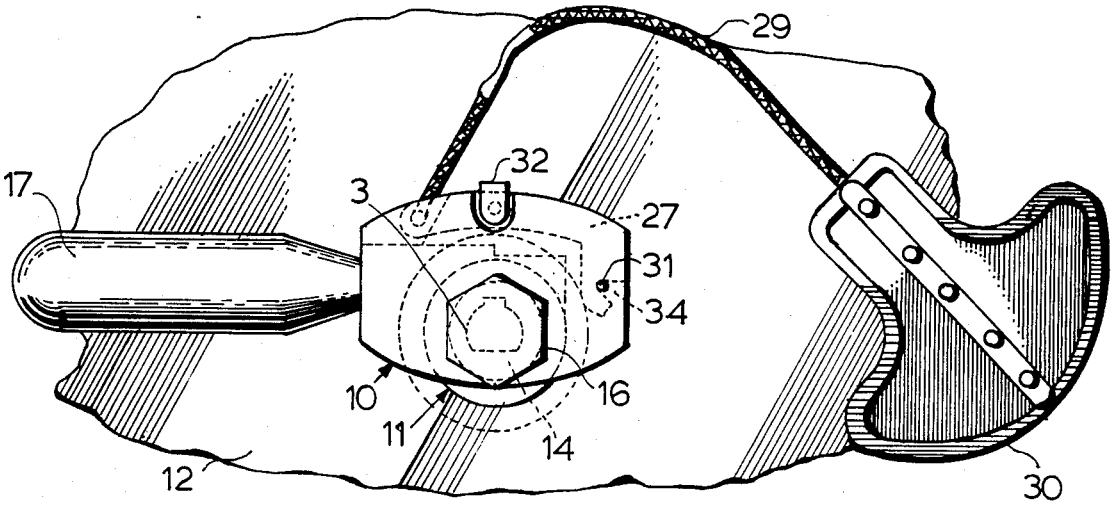
FIG. 1 is a view in side elevation of a manually operated inflator provided with the mounting in accordance with the invention of the piercing pin-operating cam and lever which permits their breaking away from the body of the inflator.

As mentioned above, the present invention is illustrated in connection with its use in a manually operated inflator such as that disclosed in Mackal U.S. Pat. No. 3,809,288. Turning first to FIG. 1, such inflator has a body 10 which is shown attached by a manifold 11 to the wall of an inflatable article, a portion of which is shown at 12. The manifold 11 has a D-shaped tubular stem 14 which is received in the similarly shaped passage 15 in the body 10 of the inflator, is sealed thereto, and held therein by suitable means including cap nut 16.

As shown in FIG. 2, a gas capsule 17 containing, for example, $CO_2$, has its externally threaded neck threadedly received within an internally threaded insert molded into the body of the inflator. A frangible seal 20 is disposed across the neck of the capsule, such seal being pierced by the sharpened forward end of a piercing pin 21 when the piercing pin is thrust in the direction from right to left.

In FIG. 2 the piercing pin is shown after it has punctured or pierced the seal by having been thrust to the left by a cam 24 to which there is integrally connected a lever 27. The lever has been turned clockwise to the position thereof shown in FIG. 1 to that in FIG. 2, wherein the high point of cam 24 engages the rear end of the piercing pin, by the pulling by a user upon a lanyard 29 secured to the outer free end of the lever. The lanyard is conveniently provided with a handle 30, as shown.

The piercing pin has an enlarged rear end part 25 which is accurately received within a bore 22 within which the piercing pin slides, the pin being sealed in such bore by an O-ring 26. The piercing pin is constantly urged in the direction from left to right by a coil compression spring 28 which maintains the rear end part 25 of the piercing pin in engagement with the active surface of the cam 24 when the cam is in any of its angular positions from that of FIG. 1 to that of FIG. 2. Preferably the rear end 33 of part 25 of the piercing pin is made of plastic material having a low coefficient of friction.

The cam and lever combination is pivotally mounted upon the body 10 of the inflator by a pivot pin 31 affixed to body 10. Rather than having the pivot pin 31 pass through a hole in the cam so that the cam and lever cannot separate from body 10, in accordance with the prior art as exemplified by Mackal U.S. Pat. No. 3,809,288, in accordance with the present invention the hole in the cam receiving the pivot pin 31 is replaced by a sectorshaped notch 34 having a rounded root portion in the form of a part of a circular cylinder having a diameter such as accurately to receive pin 31. The notch 34 is so oriented with respect to the cam 24 that when the cam and lever combination are turned clockwise from the position thereof shown in FIG. 1 to the position thereof shown in FIG. 2, there is a firm thrusting engagement provided between the walls of the slot 34 including the part-circular root thereof and pin 31 until the cam and lever have been turned clockwise preferably at least slightly past the position thereof shown in FIG. 2.

Only after the piercing pin has been thrust to the left to pierce the sealing means of the gas capsule, and preferably only after the high point of cam 24 has passed the rear end 25 of the piercing pin is the pintle pin 31 freed from the notch 34 and vice versa. Such condition is shown in FIG. 3, wherein the walls and root of the notch 24 are now freed from the pivot pin 31 and the cam and lever are moving out of and away from the body 10 of the inflator, their work having been accomplished.

It is to be noted that in FIG. 1 the lever 27 is shown as being returned in its cam-inoperative position by a member 32. Member 32 is the subject of the U.S. patent application Ser. No. 305,038, now U.S. Pat. No. 4,416,593, filed Sept. 23, 1981, by the present inventor, and entitled "Inflator Lock Guard". Not only does such member 32 stably retain the lever and cam combination in inoperative position, to prevent their being swung in a clockwise direction until needed, but it retains the cam and lever stably against any substantial movement to the left in FIG. 1 with respect to the body 10 of the inflator, thereby securing the cam lever, when they are in the position of FIG. 1, against unwanted movement with respect to the body 10 of the inflator in a direction to the left, in spite of the fact that the notch 34 is open at its then right-hand end.

The substance of U.S. patent application Ser. No. 305,038, now U.S. Pat. No. 4,416,593 is incorporated herein by reference. However, for the sake of conpleteness, it will be pointed out that the member 32 is of U-shape, is made of strong resilient plastic material, and has two aligned opposing part spherical projections which snap into aligned holes 36 on the opposite sides of the body 10 of the inflator. As shown, the body of the inflator is provided with aligned recesses on opposite sides thereof which receive the vertical legs of member 32. The snapping of the oppositely disposed projections on the inner surfaces of such legs of member 32 into the holes 36 insures the holding of the lever 27 in the position of FIG. 1 by the engagement or substantial engagement of the horizontal part member 32 with the lever 27 until a pronounced, but not excessive, turning motion in a clockwise direction is exerted upon lever 27 by the pulling upon the lanyard 29 in a directiion upwardly and usually to the right oin FIG. 1.

The stable retention of the lever and cam in their at-rest position of FIG. 1 is also aided by the thrusting of the piercing pin rearwardly by the spring 28 and thus the thrusting of the rear end part 33 against the active portion of the cam 24. This causes a counterclockwise torque to be imposed upon the cam and lever until the high point of the cam comes into engagement with the end part 33 of the piercing pin. Not only that, but when the cam and lever are in their at-rest position of FIG. 1, the spring 28, acting through the piercing pin, directly thrusts the root 35 of the notch 34 against pivot pin 31. The thrust exerted upon the cam in a rearward direction (to the right in the drawings) by the spring 28 acting through the piercing pin continues until the cam and lever have been turned past the position thereof shown in FIG. 2. Thereafter, as the piercing pin moves further rearward from the position thereof shown in FIG. 2 toward the rearwardly extended position shown in FIG. 3, the spring 28, acting through the piercing pin, adds its rearwardly directed thrust to the rearwardly directed pull exerted upon the cam by the lanyard. Such two forces assure the quick and unfailing separation of the cam and lever from the body of the inflator.

The embodiment of cam and lever combination shown in FIG. 4 differs from that in the first illustrated embodiment by having an added guiding part 37 therein opposite and somewhat below the slot 34 and at the junction between the cam and the lever. Part 34 affords increased resistance against the canting of the combined cam and lever in the slot in the inflator body when the lever is subjected to a pull directed at a substantial angle relative to the plane of the slot in the inflator body.

Although the invention is illustrated and described with reference to a plurality of embodiments thereof, it is to be expressly understood that it is in no way limited to the disclosure of such preferred embodiments but is capable of numerous modifications within the scope of the appended claims.

I claim:

1. In an inflator for a gas inflatable article, the inflator having a body adapted to be mounted upon and sealed to the inflatable article, means for mounting a compressed gas-containing capsule upon the body and sealing it thereto, and manually operated capsule piercing means on the body including a piercing pin selectively movable forwardly toward the capsule to cause the forward end of the piercing pin to pierce the capsule and thus to release gas therefrom to flow into the inflatable article, said last named means including a cam having an active cam surface which gradually increases in radius from a low point to a high point, a pivot pin on the body, means on the cam for rotatably mounting it upon the pivot pin, resilient means constantly urging the piercing pin rearwardly so that its rear end engages and follows the cam, and a cam rotating lever attached at a first end to the cam and having a second, outer free end, the improvement wherein the means on the cam for rotatably mounting it upon the pivot pin has a seat receiving the pivot pin, said seat having a root in which the pivot pin is received when the cam and lever are in their ready at-rest position, and an open-ended passage in the cam extending generally radially outwardly from the seat therein, said passage being so disposed relative to the high point of the cam as to afford the free escape of the cam from the body of the inflator in a direction away from the pivot pin when the cam has been turned in the capsule piercing direction from its at-rest position suficiently for the piercing of the capsule to have been accomplished.

2. The inflator of claim 1, wherein the lever lies generally parallel with one edge of the inflator body when the lever is in its ready at-rest position, and a zone of the cam which is of small radius and is disposed remote from the high point of the cam then confronts the rear end of the piercing pin.

3. The inflator of claim 1, wherein said resilient means comprises a spring, wherein in the at-rest position of the cam and lever the spring urges the cam toward the pivot pin so as stably to position the root of the seat upon the pin.

4. The inflator of claim 1, wherein said resilient means comprises a spring, wherein when the cam and lever are in the at-rest position the spring acting through the piercing pin exerts a torque upon the cam and lever resiliently maintaining them in such at-rest position.

5. The inflator of claim 1, comprising a lanyard secured to the outer end of the lever.

6. The inflator of claim 1, wherein the lever and cam are integral and form a generally L-shaped member having two arms, the cam forms the outer end of a first arm of the L-shaped member, and the seat in the cam is open-sided on the rear edge of the first arm of the L-shaped member disposed remote from the free outer end of the second arm of the L-shaped member.

7. The inflator of claim 1, wherein the root of the seat in the cam is of circular cylindrical configuration and encompasses an angle somewhat less than 180 degrees.

8. The inflator of claim 1, wherein the passage which extends generally radially outwardly from the seat is generally sector-shaped and has its apex disposed generally on the geometrical center of the root of the seat.

9. The inflator of claim 1, wherein the piercing pin has a low friction plastic member disposed on the rear end thereof, said plastic member slidingly cooperating with the active surface of the cam.

10. The inflator of claim 1, comprising a releasable means locking the lever in its at-rest position.

11. The inflator of claim 1, wherein the cam freely escapes from the body of the inflator in a direction away from the pivot pin only when the cam has been turned in the capsule piercing direction from its at-rest position sufficiently for the piercing of the capsule to have been accomplished.

12. The inflator of claim 1, wherein the cam freely escapes from the body of the inflator in a direction generally parallel to the piercing pin and in a rearward direction away from the pivot pin only when the cam has been turned in the capsule piercing direction from its at-rest position sufficiently for the piercing of the capsule to have been accomplished.

* * * * *